US006761649B1

(12) United States Patent
Medley, Jr.

(10) Patent No.: US 6,761,649 B1
(45) Date of Patent: Jul. 13, 2004

(54) BALL RETURN APPARATUS

(76) Inventor: William H. Medley, Jr., 338 Oglethorpe St. NE., Washington, DC (US) 20011

( * ) Notice: Subject to any disclaimer, the term of this patent is extended or adjusted under 35 U.S.C. 154(b) by 0 days.

(21) Appl. No.: 10/159,073

(22) Filed: May 31, 2002

(51) Int. Cl.[7] ..... A63B 69/00
(52) U.S. Cl. ..... 473/433; 473/422
(58) Field of Search ..... 473/433, 432, 473/431, 422; D21/305, 323, 702; 273/397

(56) References Cited

U.S. PATENT DOCUMENTS 1,574,201 A * 2/1926 Lynch ..... 273/397
4,697,810 A 10/1987 Mathison
4,786,371 A 11/1988 Postol
4,838,549 A * 6/1989 Woodall ..... 473/433
D315,383 S 3/1991 Cochran et al.
5,016,875 A 5/1991 Joseph
5,312,099 A 5/1994 Oliver

* cited by examiner

*Primary Examiner*—Paul T. Sewell
*Assistant Examiner*—Michael Chambers

(57) ABSTRACT

A ball return apparatus for providing a moveable, netted frame that would redirect balls toward the shooter, after the ball passes through the hoop or if the player misses. The ball return apparatus includes a frame assembly having a plurality of vertical support members. The frame assembly has a plurality of horizontal support members. The netting assembly forms a plurality of walls between the horizontal and the vertical support members of the framing assembly. A ball return assembly is positioned interior to the netting assembly. The ball return assembly is for returning a ball to a user.

14 Claims, 2 Drawing Sheets

BALL RETURN APPARATUS

BACKGROUND OF THE INVENTION

1. Field of the Invention

The present invention relates to ball return devices and more particularly pertains to a new ball return apparatus for providing a moveable, netted frame that would redirect balls toward the shooter, after the ball passes through the hoop or if the player misses.

2. Description of the Prior Art

The use of ball return devices is known in the prior art. U.S. Pat. No. 4,838,549 describes a basketball retriever device adapted to fit around a basketball basket to guide the return of the basketball to the front end of the chute. Another type of ball return device is U.S. Pat. No. Des. 315,383 describes an ornamental design for a combined basketball game goal and return. U.S. Pat. No. 4,786,371 describes a backboard basketball retriever. U.S. Pat. No. 5,312,099 describes a ball return apparatus for basket ball goal included an elongated framework including an upstanding a back pole having a hook at the top to removably engage a hoop support bracket of a conventional basketball goal assembly. U.S. Pat. No. 4,697,810 describes a basket ball training device for use in shooting baskets in association with a standard backboard goal. U.S. Pat. No. 5,016,875 describes portable basketball retrieval apparatus that collects and returns a succession of shot basketballs to a practicing player.

While these devices fulfill their respective, particular objectives and requirements, the need remains for a device that allows a user to shoot baskets from different angles with minimal obstruction.

SUMMARY OF THE INVENTION

The present invention meets the needs presented above by providing 3 slots that allow the user to adjust the frame assembly in multiple positions.

Another object of the present invention is to provide a new ball return apparatus that is easy to setup and quickly rolled to a desired location.

Still another object of the present invention is to provide a new ball return apparatus that allows the user to shoot from all angles on the court.

To this end, the present invention generally comprises a frame assembly having a plurality of vertical support members. The frame assembly has a plurality of horizontal support members. The netting assembly forms a plurality of walls between the horizontal and the vertical support members of the framing assembly. A ball return assembly is positioned interior to the netting assembly. The ball return assembly is for returning a ball to a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
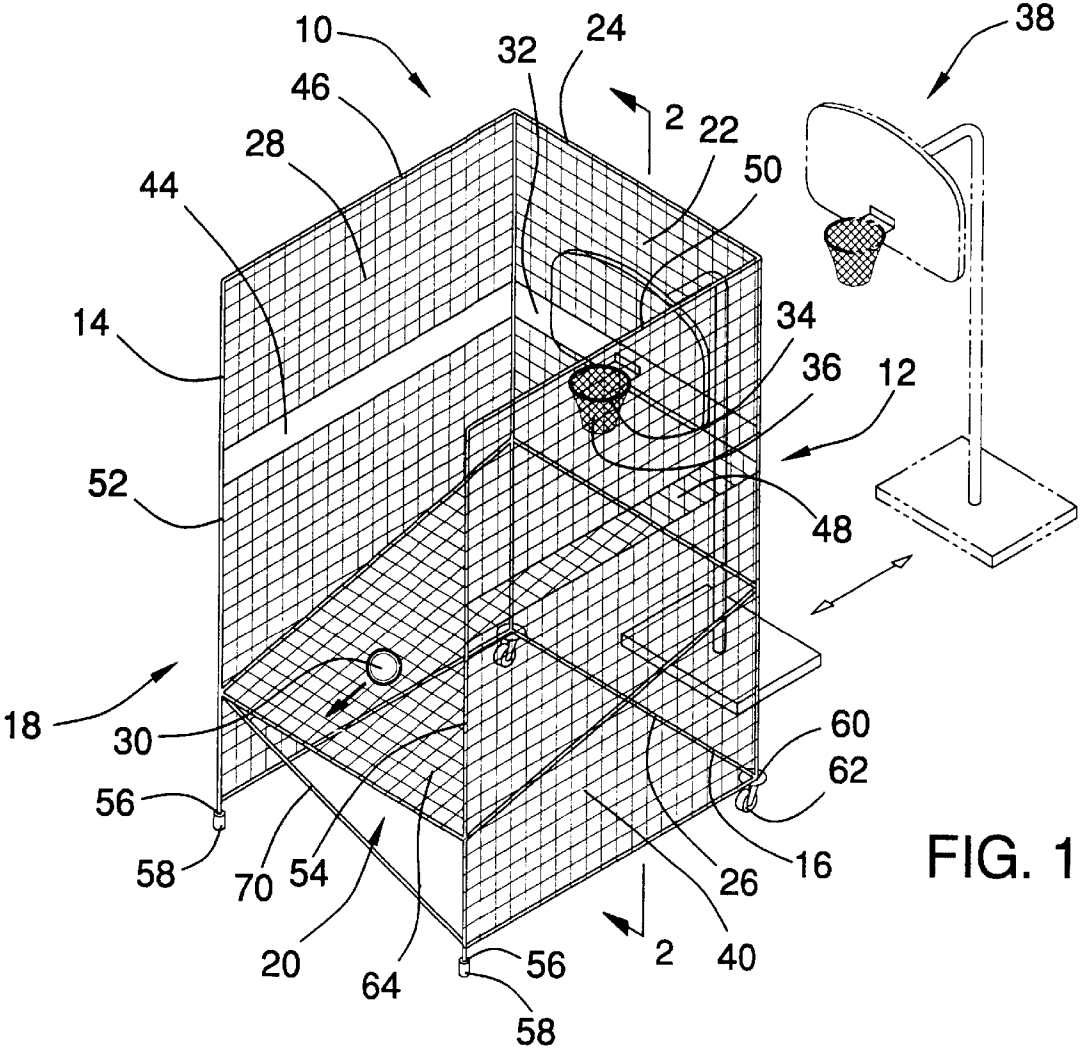
FIG. 1 is a perspective view of a new ball return apparatus according to the present invention.
Figure 2:
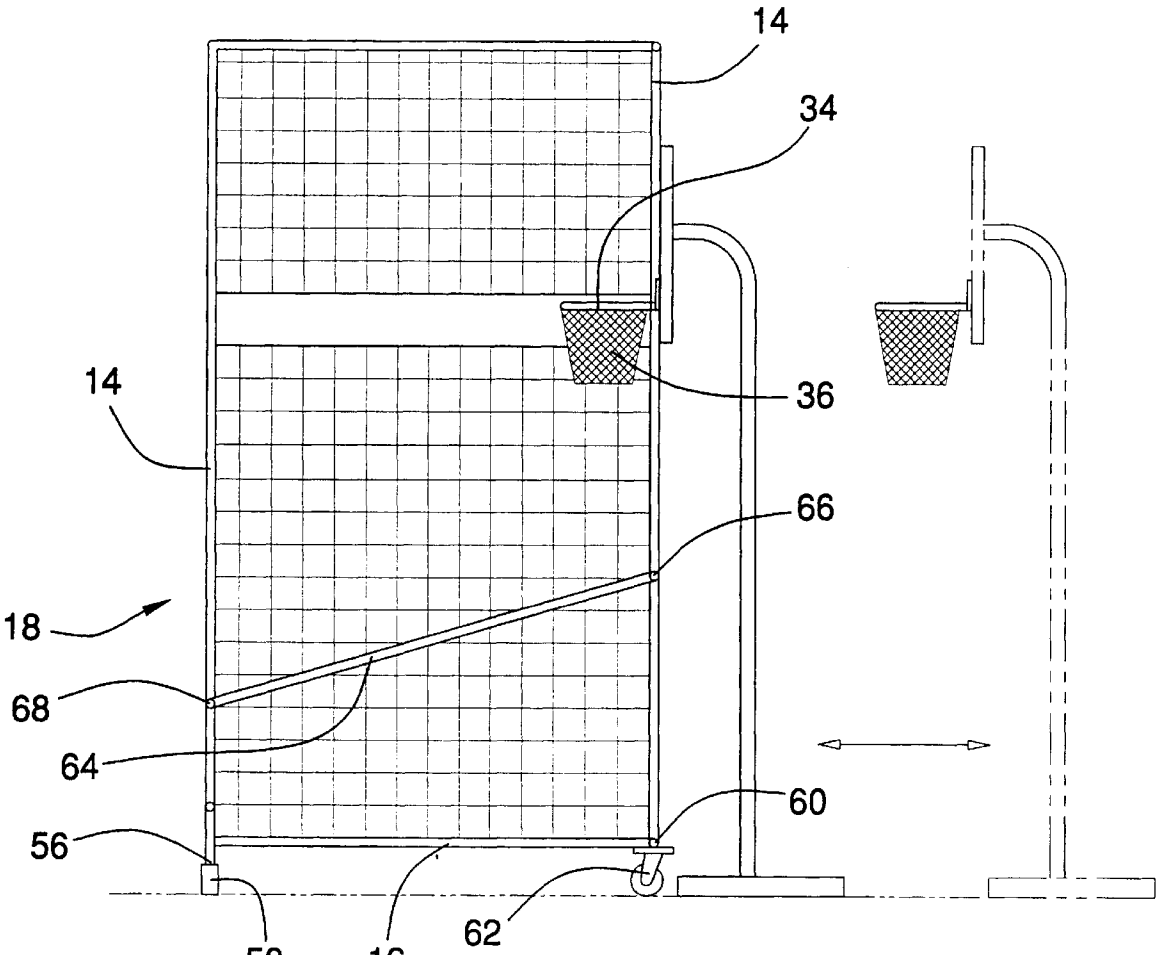
FIG. 2 is a side view of the present invention.

With reference now to the drawings, and in particular to FIGS. 1 through 2 thereof, a new ball return apparatus embodying the principles and concepts of the present invention and generally designated by the reference numeral 10 will be described.

As best illustrated in FIGS. 1 through 2, the ball return apparatus 10 generally comprises a frame assembly 12 having a plurality of vertical support members 14. The frame assembly 12 has a plurality of horizontal support members 16 . The netting assembly 18 forms a plurality of walls between the horizontal 16 and the vertical 14 support members of the framing assembly 12. A ball return assembly 20 is positioned interior to the netting assembly 18. The ball return assembly 20 is for returning a ball to a user.

The frame assembly 12 further includes a first wall 22 that has a top horizontal support member 24 and a bottom horizontal support member 26. The first wall 22 has a pair of vertical support members 14 that extend between the top 24 and bottom 26 horizontal support members such that the first wall 22 is substantially rectangular.

The netting assembly 18 further includes a first screen member 28. The first screen member 28 is coupled to the first wall 22. The first screen member 28 is for directing a basketball 30 toward a user.

The netting assembly 18 further includes a first slot 32 that has a longitudinal axis. The first slot 32 is positioned adjacent to the top horizontal support member 24. The first slot 32 is for selectively receiving a rim 34 and net 36 of a basketball hoop 38.

The netting assembly 18 further includes a second screen member 40. The second screen member 40 is coupled to the first wall 42. The second screen member 40 is in a spaced parallel relationship with the first screen member 28. The second screen member 40 is for directing a basketball 30 toward a user.

The netting assembly 18 includes a second slot 44 that has a longitudinal axis. The second slot 44 is positioned adjacent to a first side horizontal member 46. The second slot 44 is for selectively receiving a rim 34 and net 36 of a basketball hoop 38.

The netting assembly 18 includes a third slot 48 that has a longitudinal axis. The third slot 48 is positioned adjacent to a second side horizontal member 50. The third slot 48 is for selectively receiving a rim 34 and net 36 of a basketball hoop 38.

The first 28 and second 40 screen members further includes a first vertical member 52 and a second vertical member 54. Each of the first 52 and second 54 vertical members have a bottom end 56. Each of the bottom ends 56 is for coupling a rubber foot pad 58. The rubber foot pad 58 is for stabilizing the assembly to a horizontal support surface such as a floor.

The bottom horizontal support member 26 of the first wall 22 forms a pair of junctures 60 with the vertical members 14 of the first wall 22. The junctures 60 are for facilitating coupling of a pair of casters 62. The casters 62 are for facilitating movement of the assembly across a horizontal support surface such as a floor.

A ball return member 64 is positioned medially between the first wall 22 and between the first 28 and second 40 screen members. The ball return member 64 has a first end 66 and a second end 68. The first end 66 is coupled to the vertical support members 14 of the first wall 22. The ball return member 64 has a second end 68 coupled to the first 52 and second 54 vertical members of the first 28 and the second 40 screen members. The first end 66 of the ball return member 64 is substantially higher than the second end.

A brace member 70 is positioned between the first 52 and the second 54 vertical support members. The brace member 70 provides stability to the frame assembly 12.

In an embodiment the present invention has an overall width of approximately 5 feet, a length of approximately 6 feet, and a height of approximately 13 feet.

In use, a user would simply wheel the present invention in front of a basket post, backboard and hoop. The frame assembly could be maneuvered so that the hoop and net pass through the opening in the rear net panel. An individual could then commence shooting a basketball at the hoop. In the event that the user makes the shot, or even misses in close proximity, the ball would fall in to the frame and be redirected forward by the ball return member in the center of the frame assembly. This would effectively send the ball back toward the player, thus eliminating the need to retrieve the ball after the shot. In the event the user wishes to practice from either far side of the basket, the frame assembly could be moved and the hoop inserted either through the left or right netted panel on the unit. Even if the player over shoots, the ball would rebound off the rear net panel and roll off the horizontal panel and back to the shooter.

With respect to the above description then, it is to be realized that the optimum dimensional relationships for the parts of the invention, to include variations in size, materials, shape, form, function and manner of operation, assembly and use, are deemed readily apparent-and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ball return apparatus for use with a convention basketball hoop and backboard comprising:

a frame assembly, said frame assembly having a plurality of vertical support members, said frame assembly having a plurality of horizontal support members;

said netting assembly forming a plurality of walls between said horizontal and said vertical support members of said framing assembly;

a ball return assembly positioned interior to said netting assembly, said ball return assembly being for returning a ball to a user;

wherein said frame assembly further comprises a first wall, said first wall having a top horizontal support member and a bottom horizontal support member, said first wall having a pair of vertical support members extending between said top and bottom horizontal support members such that said first wall is substantially rectangular;

wherein said netting assembly further comprises a first screen member, said first screen member being coupled to said first wall, said first screen member being for directing a basketball toward a user; and wherein said netting assembly further comprises a first slot having a longitudinal axis, said first slot being positioned adjacent to said top horizontal support member, said first slot being for selectively receiving a rim and net of a basketball hoop.

2. The assembly of claim 1 wherein said netting assembly further comprises a second screen member, said second screen member being coupled to said first wall, said second screen member being in a spaced parallel relationship with said first screen member, said second screen member being for directing a basketball toward a user.

3. The assembly of claim 2 wherein said netting assembly comprises a second slot having a longitudinal axis, said second slot being positioned adjacent to a first side horizontal member, said second slot being for selectively receiving a rim and net of a basketball hoop.

4. The assembly of claim 2, wherein said first and second screen members further comprises a first vertical member and a second vertical member, each of said first and second vertical members have a bottom end, each of said bottom ends being for coupling a rubber foot pad, said rubber foot pad being for stabilizing said assembly to a horizontal support surface such as a floor.

5. The assembly of claim 4, wherein a brace member is positioned between said first and said second vertical support members, said brace member provides stability to said frame assembly.

6. The assembly of claim 1, wherein said netting assembly comprises a third slot having a longitudinal axis, said third slot being positioned adjacent to a second side horizontal member, said third slot being for selectively receiving a rim and net of a basketball hoop.

7. The assembly of claim 1, wherein said bottom horizontal support member of said first wall forms a pair of junctures with said vertical members of said first wall, said junctures being for facilitating coupling of a pair of casters, said casters being for facilitating movement of said assembly across a horizontal support surface such as a floor.

8. The assembly of claim 1, wherein a ball return member is positioned medially between said first wall and between said first and second screen members, said ball return member having a first end and a second end, said first end being coupled to said vertical support members of said first wall, said ball return member having a second end coupled to said first and second vertical members of said first and said second screen members, said first end of said ball return member being substantially higher than said second end.

9. A ball return apparatus for use with a convention basketball hoop and backboard comprising:

a frame assembly, said frame assembly having a plurality of vertical support members, said frame assembly having a plurality of horizontal support members;

said netting assembly forming a plurality of walls between said horizontal and said vertical support members of said framing assembly;

a ball return assembly positioned interior to said netting assembly, said ball return assembly being for returning a ball to a user;

wherein said frame assembly further comprises a first wall, said first wall having a top horizontal support member and a bottom horizontal vertical members have a bottom end, each of said bottom ends being for coupling a rubber foot pad, said rubber foot pad being for stabilizing said assembly to a horizontal support surface such as a floor;

wherein said bottom horizontal support member of said first wall forms a pair of junctures with said vertical members of said first wall, said junctures being for facilitating coupling of a pair of casters, said casters being for facilitating movement of said assembly across a horizontal support surface such as a floor;

wherein a ball return member is positioned medially between said first wall and between said first and second screen members, said ball return member having a first end and a second end, said first end being coupled to said vertical support members of said first wall, said ball return member having a second end coupled to said first and second vertical members of said first and said second screen members, said first end of said ball return member being substantially higher than said second end; and wherein a brace member is positioned between said first and said second vertical support members, said brace member provides stability to said frame assembly.

10. The apparatus of claim 9, wherein said first wall extends beyond a first and a second sides of the backboard to facilitate returning the ball to a user if the user misses the backboard and the hoop.

11. The apparatus of claim 9, wherein said first wall being coupled to said first screen member without any bracing extending into an interior of the apparatus thereby preventing a ball from being unnecessarily deflected by encountering the bracing in route to the backboard and hoop.

12. The apparatus of claim 9, wherein said first wall being coupled to said second screen member without any bracing extending into an interior of the apparatus thereby preventing a ball from being unnecessarily deflected by encountering the bracing in route to the backboard and hoop.

13. The apparatus of claim 9, wherein said first wall extends beyond a top of the backboard to facilitate returning the ball to a user if the user misses the backboard and the hoop.

14. The apparatus of claim 9, further comprising:

said first wall extends beyond a first and a second sides of the backboard to facilitate returning the ball to a user if the user misses the backboard and the hoop;

wherein said first wall extends beyond a top of the backboard to facilitate returning the ball to a user if the user misses the backboard and the hoop;

said first wall being coupled to said first screen member without any bracing extending into an interior of the apparatus thereby preventing a ball from being unnecessarily deflected by encountering the bracing in route to the backboard and hoop; and said first wall being coupled to said second screen member without any bracing extending into an interior of the apparatus thereby preventing a ball from being unnecessarily deflected by encountering the bracing in route to the backboard and hoop.

* * * * *